US007311457B2

(12) United States Patent
Pink

(10) Patent No.: US 7,311,457 B2
(45) **Date of Patent: *Dec. 25, 2007**

(54) NAIL POLISH CONTAINER AND APPLICATOR CAP

(75) Inventor: Jeff Pink, Beverly Hills, CA (US)

(73) Assignee: J.P. Gripper LLC, Beverly Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/228,232

(22) Filed: Sep. 19, 2005

(65) Prior Publication Data

US 2006/0013638 A1 Jan. 19, 2006

Related U.S. Application Data

(63) Continuation of application No. 10/949,371, filed on Sep. 27, 2004, now Pat. No. 6,966,716, which is a continuation of application No. 09/960,948, filed on Sep. 25, 2001, now abandoned.

(60) Provisional application No. 60/236,150, filed on Sep. 29, 2000.

(51) Int. Cl.
*A46B 11/00* (2006.01)
*A46B 5/02* (2006.01)

(52) U.S. Cl. ..... 401/129; 401/126; 401/6; 16/430

(58) Field of Classification Search ..... 401/6, 401/118, 121, 122, 126, 128, 130; 16/430
See application file for complete search history.

(56) References Cited

U.S. PATENT DOCUMENTS 1,062,961 A 5/1913 Funcke
D116,066 S 8/1939 Twomey
D181,136 S 10/1957 Elmhurst
2,850,194 A 9/1958 Williams
3,147,511 A 9/1964 Pittoni
D215,083 S 9/1969 Carter
D258,498 S 3/1981 Hartmann
4,627,548 A 12/1986 Thompson
4,702,129 A 10/1987 Allen
4,712,936 A 12/1987 Kessler
4,733,788 A 3/1988 D Amico
4,841,996 A * 6/1989 Gueret ..... 132/320
4,921,366 A 5/1990 Hurrell
4,955,745 A 9/1990 Vauquelin
5,172,992 A 12/1992 Ackermann (Continued)

FOREIGN PATENT DOCUMENTS

DE 196 32 313 A1 2/1997

(Continued)

*Primary Examiner*—David J. Walczak
(74) *Attorney, Agent, or Firm*—Shlesinger, Arkwright & Garvey LLP

(57) ABSTRACT

A nail polish container and applicator cap comprising a reservoir for containing nail polish to be applied, an opening into the reservoir, an applicator cap for sealing engagement with the opening, the applicator cap operatively associated with an applicator brush, the brush formed from bristles that are aligned in substantially the same direction as the longitudinal axis of the applicator cap, and an overshell of compressible material surrounding the applicator cap, the overshell providing a finger gripping surface on the applicator cap.

19 Claims, 3 Drawing Sheets

U.S. PATENT DOCUMENTS

| | | | | |
|---|---|---|---|---|
| 5,277,324 | A | 1/1994 | Cash | |
| 5,443,172 | A | 8/1995 | Gabriele | |
| 5,511,445 | A | 4/1996 | Hildebrandt | |
| 5,595,198 | A | 1/1997 | Kemmerer | |
| D386,410 | S | 11/1997 | Mahlmann | |
| 5,716,150 | A | 2/1998 | Gueret | |
| 5,826,741 | A | 10/1998 | Dumler et al. | |
| 5,888,005 | A | 3/1999 | Gueret | |
| 5,896,620 | A | 4/1999 | Mink | |
| 5,926,901 | A | 7/1999 | Tseng et al. | |
| 5,957,142 | A | 9/1999 | Karafilis | |
| 5,964,009 | A | 10/1999 | Hoepfl et al. | |
| 5,975,602 | A | 11/1999 | Zan | |
| 6,027,151 | A | 2/2000 | McNab et al. | |
| 6,033,143 | A | 3/2000 | Gueret | |
| 6,062,753 | A | 5/2000 | Hadtke et al. | |
| 6,195,830 | B1 | 3/2001 | Bruschi | |
| 6,298,516 | B1 * | 10/2001 | Beals et al. | 15/143.1 |

FOREIGN PATENT DOCUMENTS

| | | |
|---|---|---|
| FR | 2 553 383 | 4/1985 |
| GB | 1 591 975 | 7/1981 |
| GB | 2 195 883 | 4/1988 |
| GB | 2 328 683 | 3/1999 |
| JP | 10297161 | 11/1988 |
| JP | 09-188350 | 7/1997 |
| JP | 2000-201729 | 1/2000 |
| JP | 2001-150858 | 6/2001 |
| WO | WO 99/44465 | 9/1999 |

* cited by examiner

FIG. 2
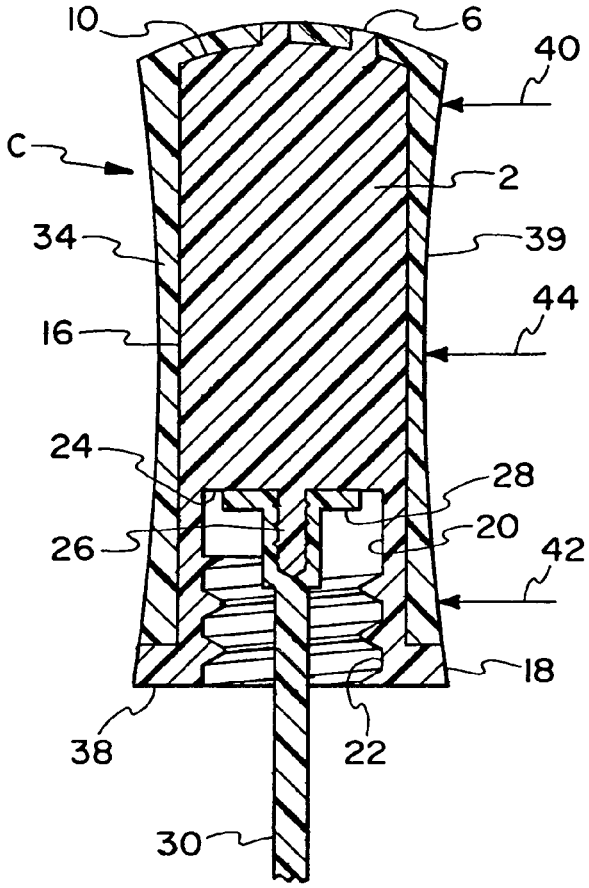
FIG. 7
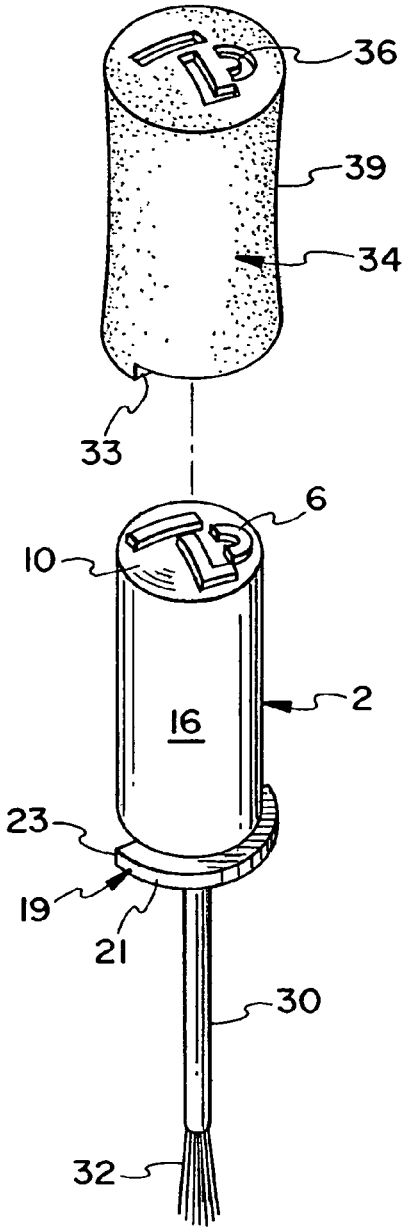
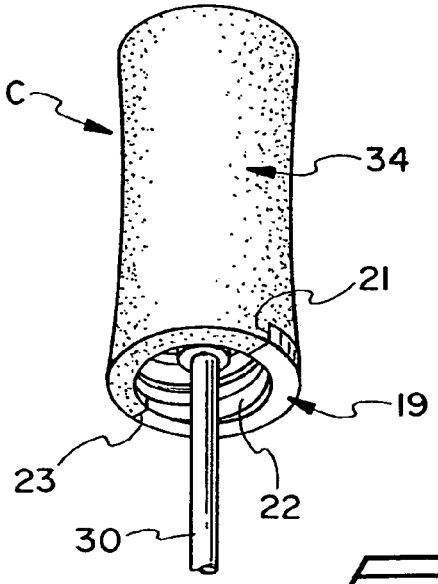
FIG. 6

NAIL POLISH CONTAINER AND APPLICATOR CAP

CROSS-REFERENCE TO RELATED APPLICATIONS

This application is a continuation of U.S. Ser. No. 10/949,371 filed on Sep. 27, 2004, now U.S. Pat. No. 6,966,716, which is a continuation of U.S. Ser. No. 09/960,948 filed on Sep. 25, 2001, now abandoned and claiming the benefit of U.S. Provisional Application Ser. No. 60/236,150 filed on Sep. 29, 2000.

FIELD OF THE INVENTION

The present invention relates to cosmetics and more particularly, a combination nail polish container and applicator cap.

BACKGROUND OF THE INVENTION

It is known to combine the screw cap of a nail polish bottle with an applicator brush. The cap functions as a closure for the bottle and as a handle for the applicator brush. However, prior art nail polish bottle caps are not well suited for use as the handle of an applicator brush.

In particular, the relatively small size of the cap compromises handling and control of the applicator brush. A small cap may only be grasped between the fingertips of the user and as a result, translational slip of the fingertips along the longitudinal axis of the cap occurs. This type of slip makes it difficult for the user to uniformly apply a detailed brush stroke onto the small surface area of a fingernail. In addition, the applicator cap of prior art nail polish bottles will have a non-angular transverse cross section i.e. it is round or otherwise provided with a curved surface. This curvature contributes to rotational slip of the fingertips as the cap is twisted onto or off of the bottle. Threading the cap on the bottle is especially difficult when nail polish applied to the users nails has not fully dried and the cap is being held lightly between the users fingertips.

Anatomical differences among users may also contribute to a poor grip on the applicator cap. Variation in finger size and shape means different users grasp the cap at different locations along the length of the cap in an effort to optimize their grip. A user having short and thin fingers is more likely to grasp and squeeze the cap near the end secured to the brush whereas a user having larger fingers may find it necessary to grip the cap at a more central location or further away from the end secured to the brush. As is apparent, grasping the cap at different locations along the length of the cap affects the grip on the cap and therefore control of the brush stroke.

Fatigue is yet another problem. To achieve a smooth brush stroke and uniform application of a coating of polish, a user tends to squeeze the cap. This application of pressure by the fingertips against the cap functions to stabilize the users hold as the user effects a sweeping motion with their hand. Repeatedly applying and releasing pressure against the cap will eventually cause fatigue and discomfort.

The material from which the cap is constructed also contributes to fatigue and a poor grip. Nail polish bottle caps are constructed from rigid and hard plastics. The exterior surface of a cap constructed from hard and inflexible materials is uncomfortable to hold over any extended period of time and as noted earlier, when the cap is repeatedly squeezed between the fingertips during use, the hard surfaces accelerate the feeling of discomfort and fatigue. Although the exterior surface of some prior art caps may be provided with ridges or similar raised structures in an effort to improve the grip against the hard and smooth surface of the cap, such efforts are known to diminish comfort.

OBJECTS AND SUMMARY OF THE INVENTION

It is an object of the invention to provide a container for nail polish having an applicator cap the exterior of which is provided with a nonrigid material adapted to eliminate rotational and translational slip during grasping of the cap, increase comfort during use, improve the quality of the brush stroke by improving dexterity and also reduce fatigue.

It is a further object of the present invention to provide a container for nail polish having a applicator cap exterior surface that is compressible so as to provide increased control of the brush stroke.

A still further object of the present invention is to provide a method for applying nail polish to a surface.

The present invention is directed to a container and cooperating applicator cap comprising a bottle for containing a material to be dispensed, the bottle having an opening for access to material contained therein and a cap for sealing engagement with the opening of the bottle, the cap comprising a rigid base member, an applicator brush fixed to the base member and aligned along the longitudinal axis thereof, an overshell of compressible material disposed on the base member, the overshell providing a gripping surface on said cap.

Other objects and advantages will be apparent from the following description and claims.

BRIEF DESCRIPTION OF THE DRAWINGS

FIG. 2 is a cross-sectional view taken along lines 2-2 of FIG. 1 with portions of the applicator brush broken away;

FIG. 6 is a perspective view of another embodiment of the applicator cap and bottle according to the present invention; and FIG. 7 is a partially exploded view of the cap shown in FIG. 6.

DETAILED DESCRIPTION OF THE PREFERRED EMBODIMENTS

Figure 1:
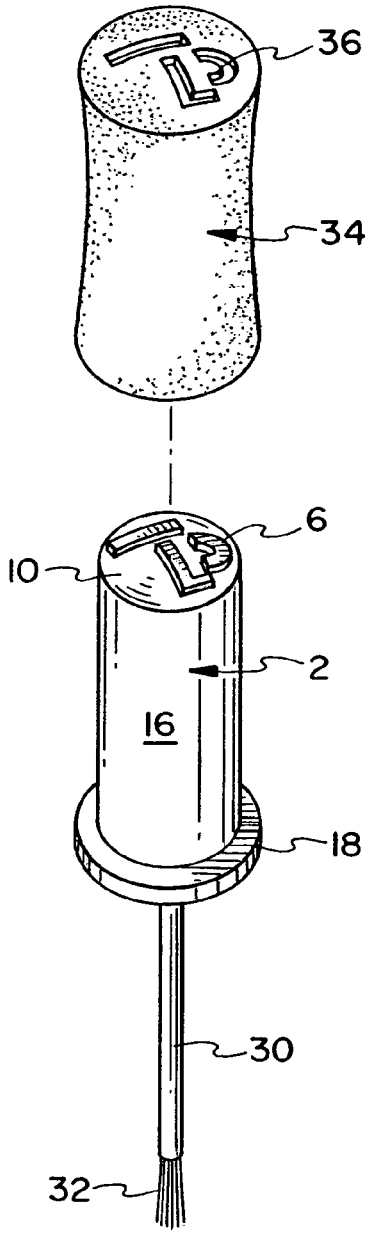
FIG. 1 is a perspective view of an applicator cap of the present invention in combination with a nail polish bottle.

FIG. 1 illustrates one embodiment of the combination bottle and applicator cap according to the present invention, the cap C shown in alignment for interconnection with the neck of a nail polish bottle B.

Figure 3:
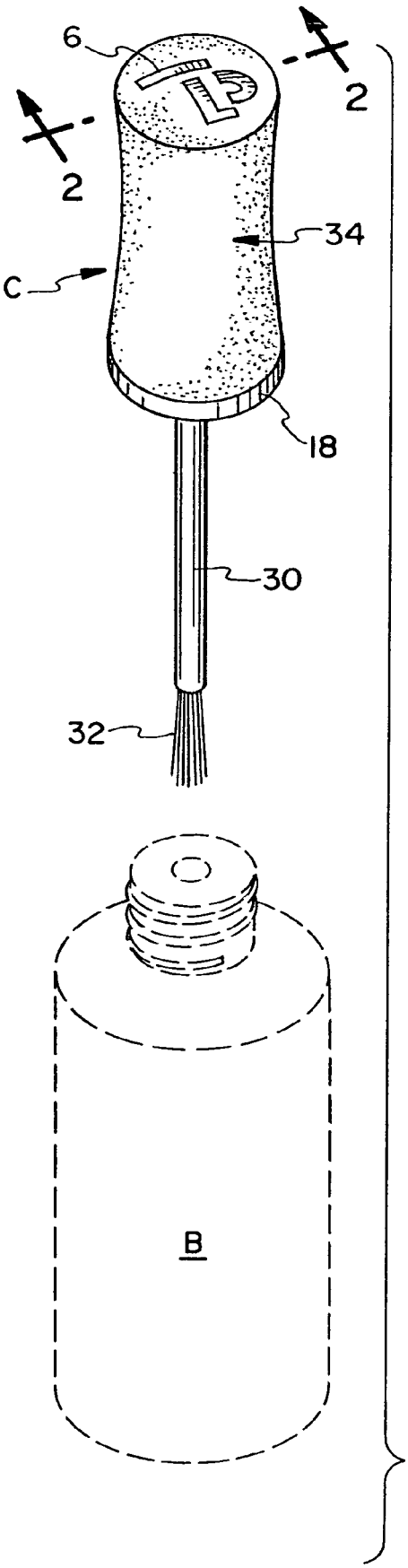
FIG. 3 is a partially exploded view of the cap shown in FIG. 1.

As best shown in FIGS. 2 and 3, cap C is provided with a generally non angular transverse cross section and includes a base member 2 preferably constructed from a material having sufficient rigidity so that the cap C may be firmly threaded onto the neck of a nail polish bottle B. In a preferred embodiment, the base member 2 is constructed from ABS copolymers, polypropylene, nylon or another rigid, inflexible material. ABS, polypropylene and nylon are preferred materials not only because they are relatively rigid and inflexible, but also because they have been found to form a good bond with the soft overshell material discussed below. Suitable polypropylene material may be obtained from BASF of Germany. The base member 2 includes an exterior side wall 16, a flange member 18 is provided at a lower end of the base member and a top surface 10 is provided at an opposite, upper end of the base member. Raised indicia 6 extends from top surface 10 and may take the form of a decorative marking such as a company logo or other printing. As is apparent, the raised indicia 6 is optional. An interior side wall 20 extends upwardly within base member 2 and terminates at an interior top surface 24. A portion of interior side wall 20 is provided with female threads 22 adapted to interconnect with the male threads of bottle B. It is within the scope of the present invention to vary the length of interior side wall 20. For example, the interior side wall 20 may be lengthened so that interior top surface 24 is disposed adjacent top surface 10 of base member 2. Interior top surface 24 is shown in the drawings to include a transversely extending post member 26 configured to be fixedly received within an end 28 of shaft 30. The opposite end of shaft 30 is provided with a brush 32. Various other embodiments for securing the shaft of the applicator brush to the base member 2 are within the scope of the present invention. For example, rather than rendering the shaft end 28 integral with the shaft 30 as shown in the drawings, a separate connector may be provided that is adapted to be press fitted against the interior side wall 20 of base member 2 and connected to an end of shaft 30.

The overshell member 34 provides a highly tactile and soft material disposed between the user and the rigid portions of the cap and applicator brush. This non-rigid exterior surface enhances the users grip with the cap to reduce or eliminate rotational and translational slippage, provides a damping effect which improves application of the polish from the brush to the nail surface and can be combined with a generally concave surface contour to reduce fatigue during use of the brush. The improvement in overall manual dexterity when using the cap of the present invention will result in a higher quality of brush stroke and application of polish that is substantially improved over that provided by the rigid prior art applicator cap devices.

The non-rigid overshell member is preferably formed from a thermoplastic elastomer material and in at least one embodiment has a shore value of about twenty-nine to about ninety-six and a thickness of about 1 mm to about 3 mm. In a preferred embodiment, the overshell will have a shore value of about forty-five and a thickness between about 1.5 mm to about 3.0 mm. As is apparent, a variety of thicknesses for the overshell material can be provided. For example, the overshell may be applied in a uniform thickness or varied in thickness along the length of the cap. The soft overshell may also be constructed from silicon rubber or other materials adapted to provide the shore values listed and/or function in the manner as required in this disclosure. Applicant has discovered that a thermoplastic elastomer material will form a good bond with the above noted materials used to form the rigid base member.

The thermoplastic elastomer as set forth above provides an applicator cap having an exterior surface of sufficient feel and resiliency so that not only is surface friction increased and the users grip on the cap improved; but also, unsteady or unwanted movement of the brush as it contacts the surface will be caused to be damped and minimized. The damping is effected by the slight deflection of the thermoplastic elastomer material forming the overshell. That is, as the cap is held and the brush is stroked against the surface of a nail, the overshell material is adapted to slightly compress against the users fingers to moderate movement of the brush on the nail surface and thereby provide a more steady and uniform brush stroke. The overshell function to reduce translational slip of the cap between the users fingers as the brush is used to apply polish to a surface and rotational slip as in the case where the cap is being twisted onto or off of a bottle.

In a preferred embodiment, the thermoplastic elastomer obtained (Advanced Elastomer Systems) is sold and marketed under the trademark SANTOPRENE. Another preferred thermoplastic elastomer may be obtained from Gummiwerk Kraiburg of Germany and is sold and marketed under the trademark THERMOLAST K. A material other than a thermoplastic elastomer is within the scope of the present invention so long as it provides the softness and damping characteristics as set forth above and achieves a high quality bond with the material comprising the underlying base member 2.

Overshell member 34 is preferably adhered to the rigid base member 2 using injection molding and in particular, injection molding in accordance with a co-extrusion process. This process employs a mold adapted to receive and cure two separate materials. For example, a polypropylene material is injected into a rotating mold (not shown) to form the rigid base member 2, the mold is then rotated to a second position and a thermoplastic elastomer is injected to form the overshell member. Other processes are within the scope of the present invention provided good adhesion is obtained between the overshell and the base member.

Returning to the drawings and in particular FIG. 2, overshell 34 is shown to not entirely cover the exterior of the rigid base member 2. That is, raised indicia 6 on base member 2 extends through openings 36 of overshell 34. As noted above, this indicia may take the form of a logo or other writing and is of course optional. The exterior surface of flange member 18 is likewise shown to not be covered by overshell 34 and as shown in the drawings, forms a continuous or coplanar surface with the exterior surface of the overshell. Flange member 18 is shown to extend laterally from the bottom 38 of cap C to provide an end that is rigid; however, it is within the scope of the present invention to remove or otherwise modify the flange in view of aesthetic or functional requirements.

In another embodiment of the present invention as best shown in FIGS. 1, 2 and 3, the exterior sidewall 39 of overshell 34 has a concave shape so that the overall thickness of the overshell is variable along the longitudinal axis of cap C. Arrows 40 and 42 indicate the regions of the overshell having increased thickness whereas arrow 44 indicates the region of the overshell having a lesser thickness. At least one advantage provided by the concave configuration is an ergonomic fit against the fingertips of a user. If the cap is grasped centrally (at about arrow 44) between a pair of opposed fingers (or ends thereof) of the users hand, and a stoke of the brush is effected against the fingernail surface, the thicker regions of the overshell (at about arrows 40 and 42) are caused to be compressed and/or flexed thereby damping the brush stroke and promoting smoother more uniform application of the polish. The compression and/or flexing of the overshell may also occur when the user grasps the cap at or near the end portions identified by arrows 40 and 42 as in the case with a user having a larger or smaller than average finger size. The overshell also functions to diminish translational and rotational slip of the cap as the concave sidewall of the cap is grasped between the ends of the users fingers. Rotational slip is a significant problem since nail polish caps almost uniformly are provided with a non-angular transverse cross section. Although the base member 2 is shown in the drawings to have substantially cylindrical shape, it is within the scope of the present invention to provide a concave or other shape for the surface of the exterior side wall 16.

Figure 4:
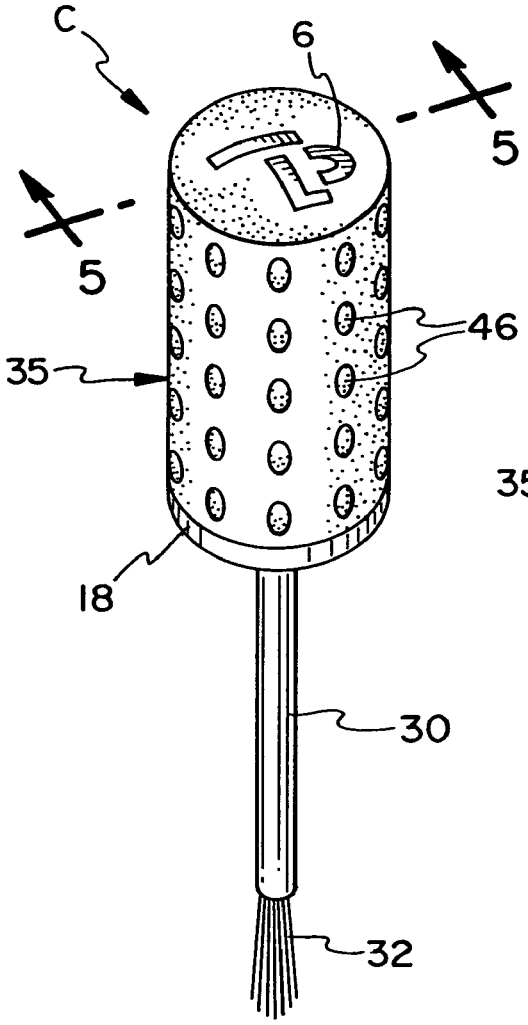
FIG. 4 is perspective view of another embodiment of the cap and bottle according to the present invention.
Figure 5:
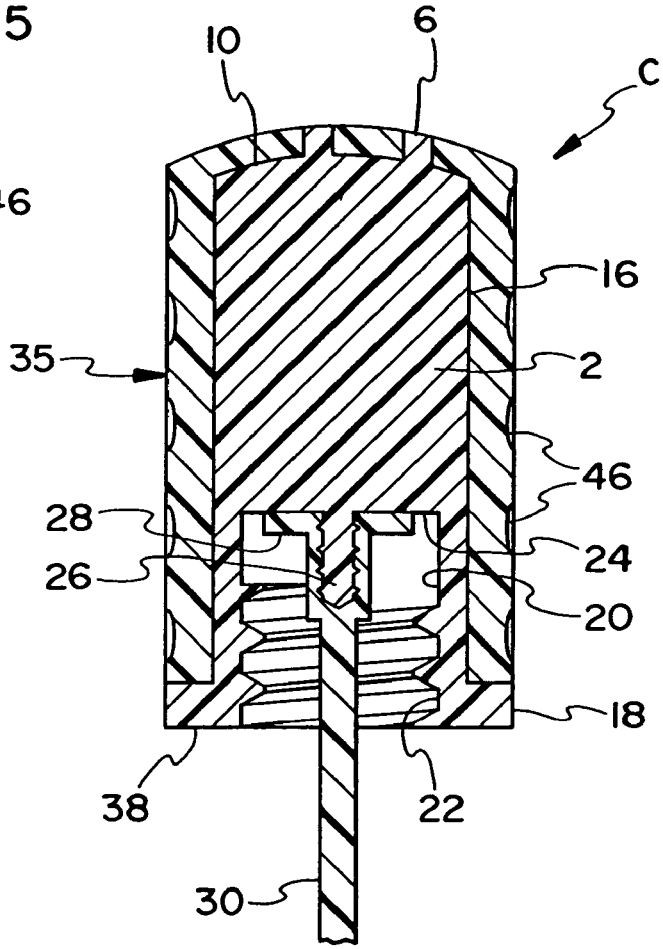
FIG. 5 is a cross-sectional view taken along lines 5-5 of FIG. 4 with portions of the applicator brush broken away.

Turning to FIGS. 4 and 5, another embodiment of the present invention is shown. In the embodiment of FIGS. 4 and 5, base member 2 is preferably constructed from a material having sufficient rigidity so that the cap C may be firmly threaded onto the neck of the cooperating nail polish bottle (not shown). As in the earlier embodiments, the base member 2 is preferably constructed from ABS plastic, polypropylene, nylon or another rigid, inflexible material that is compatible with the overshell. The base member 2 includes an exterior side wall 16, a flange member 18 is provided at a lower end of the base member and a top surface 10 is provided at an opposite, upper end of the base member. Optional raised indicia 6 is shown to extend from top surface 10 and may take the form of a decorative marking such as a company logo or other printing. An interior side wall 20 extends upwardly within base member 6 and terminates at an interior top surface 24. A portion of interior side wall 20 is provided with female threads 22 adapted to interconnect with the male threads of a bottle (not shown). As in the earlier embodiments, it is within the scope of the present invention to vary the length of interior side wall 20. Also note in this embodiment, the cap does not have a concave shape but is provided with a uniform diameter throughout. Interior top surface 24 is shown in the figure to include a transversely extending post member 26 configured to be fixedly received within an end 28 of shaft 30. The opposite end of shaft 30 is provided with a brush 32. Other embodiments for securing the shaft of the applicator brush to the base member are within the scope of the present invention. In the embodiment of FIGS. 4 and 5, a non-rigid overshell member 35 is provided on the exterior of rigid base member 2. As in the other embodiments, the overshell member 35 provides a highly tactile and soft material disposed between the fingers of the user and the relatively rigid remaining portions of the cap and applicator brush. The non-rigid exterior surface of the overshell 35 enhances the users grip on the cap by reducing translational and rotational slip as well as improves application of polish from the brush to the nail surface and also functions to reduce fatigue while holding the cap. The exterior of the overshell 35 is provided with indentations or dimples 46 to further enhance the users grip on cap C. It is within the scope of the present invention to provide different surface modification, including but not limited to raised bumps or the like. While it is understood provision of indentations 46 will provide a variable thickness for overshell 35, it is within the scope of this embodiment to eliminate the indentations (as in the FIG. 2) and provide an overshell 35 having substantially uniform thickness. In such an embodiment, it is understood that the overshell 35 may be sufficiently thick so as to provide the compression and/or flexing as set forth above together with the improved grip surface. In the alternative, the overshell thickness can be lessened and rendered not compressible or flexible in which case the overshell will function to enhance the grip on the cap by providing the anti-slip characteristic.

FIGS. 6 and 7 illustrate another embodiment of the invention whereby at least a portion of the exterior side wall 16 is shown to project through the exterior side wall 39 of overshell 34. That is, projection or flange 19 extends from the exterior side wall 16 such that a portion 21 remains uncovered by overshell 34. Various other configurations showing discontinuous side wall surfaces of alternating rigid and non-rigid material are within the scope of the present embodiment. In addition to the above, the flange 19 which does not fully extend around the circumference of base member 2, provides an abutment 23 against which overshell portion 34 will contact. The contact of the overshell against the flange reduces the likelihood of separation of the overshell from the base member due to torque generated during twisting of the cap onto and off of a bottle.

It is also within the teaching of the present invention to provide a separable base member 2 and overshell 34 which may be separately formed and then glued together or otherwise joined together to provide a unitary cap C. Further, it is within the scope of the present invention to provide the indicia 6 or some other design on the side walls 16 thereby providing a discontinuous side wall surface having discrete areas of soft and compressible material and separate discrete areas of rigid material continuous with the underlying base cap. This would of course provide a cap C having an enhanced gripping surface limited to certain exterior portions of the cap.

It is also within the scope of the present invention to provide other materials for use as the overshell. Although the cap may be injection molded with separate materials as set forth above, it may also be injection molded from a single material that increases in density or softness from the interior cap to the exterior surface to thereby provide a rigid underside for support and a good connection with the bottle and the soft and resilient exterior having the gripping and damping characteristics of the present invention.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

I claim:

1. A nail polish container and applicator cap comprising:

a) a reservoir for containing nail polish, said reservoir having an opening;

b) an applicator cap adapted for threaded engagement with said reservoir opening by rotation of said applicator cap therewith, said applicator cap having a side wall, a top surface and a cross-section having a circular shape;

c) an applicator brush, said applicator brush having brush bristles aligned in substantially the same direction as the longitudinal axis of said applicator cap, and d) an overshell of compressible material mated to said applicator cap side wall and top surface to provide a fingertip gripping surface thereon, said overshell having a substantially uniform thickness throughout whereby when said applicator cap is engaged to or disengaged from said reservoir it will reduce rotational slip.

2. A nail polish container and applicator cap as in claim 1 and wherein said overshell having a durometer ratio of about twenty-nine to about ninety-six shore.

3. A nail polish container and applicator cap as in claim 1 and wherein said overshell thickness is between about 1 mm to about 3 mm.

4. A nail polish container and applicator cap as in claim 1 and wherein said overshell is a material selected from the group consisting of thermoplastic elastomers and silicon rubber.

5. A nail polish container and applicator cap as in claim 1 and wherein said applicator cap is formed from a material selected from the group consisting of polypropylene, ABS copolymers and nylon.

6. A nail polish container and applicator cap as in claim 1 and wherein said overshell having a concave configuration.

7. A nail polish container and applicator cap as in claim 1 and wherein said reservoir opening provided with male threads and said applicator cap provided with female threads for threaded engagement with said male threads.

8. A nail polish container and applicator cap as in claim 1 and wherein at least a portion of said applicator cap top surface extends through said overshell end wall.

9. A nail polish container and applicator cap as in claim 1 and further including:

a) a flange, said flange extends from said applicator cap at one end thereof and transverse to the longitudinal axis thereof.

10. A nail polish container and applicator cap comprising:

a) a reservoir for containing nail polish to be dispensed, said reservoir having an opening for access to the interior thereof, b) an applicator cap formed from rigid material and adapted for sealing engagement with said reservoir opening, said applicator cap having a side wall, a top surface at one end thereof and an annular flange at an opposite end thereof, said flange extends transverse to the longitudinal axis of said applicator cap and said side wall thereof, c) a brush for applying nail polish to a surface, said brush formed from bristles, d) a shaft, said shaft connecting said cap to said brush so that said brush bristles are aligned in substantially the same direction as the longitudinal axis of each of said cap and said shaft; and e) a one piece overshell provided on said applicator cap side wall and top surface, said overshell having a thickness on said side wall and top surface that is substantially the same and that is formed from a sufficiently compressible material whereby when said applicator cap is gripped between the fingertips of a user to apply nail polish from said brush, said bristles are caused to be dampened against excessive movement.

11. A nail polish container and applicator cap as in claim 10 and wherein said applicator cap having a circular cross-section throughout.

12. A nail polish container and applicator cap as in claim 10 and wherein said overshell constructed from a material having a durometer ratio of about twenty-nine to about ninety-six shore.

13. A nail polish container and applicator cap as in claim 10 and wherein said overshell is a material selected from the group consisting of thermoplastic elastomers and silicon rubber.

14. A nail polish container and applicator cap as in claim 10 and wherein said applicator cap is constructed from a material selected from the group consisting of polypropylene, ABS copolymers and nylon.

15. A nail polish container and applicator cap comprising:

a) a reservoir for containing nail polish, said reservoir having a threaded opening;

b) a rigid applicator cap adapted for rotational engagement with said threaded opening of said reservoir, said applicator cap having a side wall and a top surface;

c) an applicator brush, said applicator brush having brush bristles aligned in substantially the same direction as the longitudinal axis of said applicator cap, said brush bristles having a length greater than the width of said applicator brush and d) a continuous overshell having a substantially uniform thickness throughout, said overshell overlying said applicator cap side wall and top surface and formed from a sufficiently compressible material to provide a fingertip gripping surface thereon adapted to reduce rotational slip when said applicator cap is being engaged to said reservoir and translational slip when nail polish is being applied to a surface.

16. A nail polish container and applicator cap as in claim 15 and wherein at least a portion of said applicator cap top surface is covered by said overshell to provide a finger gripping surface thereon.

17. A nail polish container and applicator cap as in claim 15 and wherein said overshell having a generally concave configuration.

18. A nail polish container and applicator cap as in claim 15 and wherein said applicator cap provided with a circular cross-section.

19. A nail polish container and applicator cap as in claim 15 and wherein said overshell has a thickness between about 1 mm to about 3 mm.

* * * * *